US007427012B2

(12) United States Patent
Saffel et al.

(10) Patent No.: US 7,427,012 B2
(45) Date of Patent: Sep. 23, 2008

(54) POSTAL MAILBOX

(76) Inventors: Jasen Jay Saffel, 1325 12th St., Cottage Hills, IL (US) 62018; Jack B. Crider, 1325 12th St., Cottage Hills, IL (US) 62018

( * ) Notice: Subject to any disclaimer, the term of this patent is extended or adjusted under 35 U.S.C. 154(b) by 0 days.

(21) Appl. No.: 11/268,980

(22) Filed: Nov. 8, 2005

(65) Prior Publication Data

US 2007/0102500 A1 May 10, 2007

(51) Int. Cl.
*B65G 11/04* (2006.01)

(52) U.S. Cl. ..... 232/45; 232/17; 232/38

(58) Field of Classification Search ..... 232/45, 232/17, 38, 47; D99/29
See application file for complete search history.

(56) References Cited

U.S. PATENT DOCUMENTS

| | | | | | |
|---|---|---|---|---|---|
| 3,106,335 | A | | 10/1963 | Allan | |
| D211,545 | S | | 6/1968 | Strome | |
| 4,005,816 | A | | 2/1977 | Malik | |
| 4,220,278 | A | | 9/1980 | Hasselbring | |
| 4,382,540 | A | | 5/1983 | Kelly et al. | |
| 4,508,259 | A | | 4/1985 | Hicks | |
| 4,660,757 | A | | 4/1987 | Hicks | |
| 4,753,386 | A | * | 6/1988 | Phillion, Sr. | 232/43.1 |
| 4,757,942 | A | | 7/1988 | Young, Jr. | |
| 4,793,551 | A | * | 12/1988 | Baylor | 232/17 |
| D306,228 | S | * | 2/1990 | Hoffman et al. | D99/31 |
| 5,056,711 | A | * | 10/1991 | Bush | 232/17 |
| 5,071,063 | A | * | 12/1991 | Overstreet | 232/17 |
| 5,148,974 | A | * | 9/1992 | Clapper | 232/17 |
| D331,481 | S | | 12/1992 | Barlow | |
| D332,166 | S | * | 12/1992 | Williams | D99/29 |
| D350,004 | S | * | 8/1994 | Nicholas | D99/29 |
| 5,607,103 | A | | 3/1997 | Boling, Jr. | |
| 5,769,312 | A | | 6/1998 | Lampe | |
| 5,833,132 | A | * | 11/1998 | Bachmeier | 232/47 |
| 6,109,519 | A | * | 8/2000 | McClure | 232/17 |
| 6,234,388 | B1 | * | 5/2001 | Taylor | 232/47 |
| 6,375,071 | B1 | * | 4/2002 | Kim | 232/47 |
| 7,036,719 | B1 | * | 5/2006 | Helphrey et al. | 232/47 |
| 2002/0121543 | A1 | | 9/2002 | Simmons | |
| 2003/0205614 | A1 | | 11/2003 | Kilma, Jr. et al. | |
| 2003/0213837 | A1 | | 11/2003 | Morgan | |

* cited by examiner

*Primary Examiner*—William L. Miller
(74) *Attorney, Agent, or Firm*—Dale J. Ream

(57) ABSTRACT

A mailbox comprises a mailbox body, a door and a see-through window. The mailbox body has an interior space therein and an access opening through which the interior space is accessible. The interior space includes a cavity extending below a bottom edge of the access opening. The door is movably attached to the mailbox body adjacent the access opening and has a window opening extending therethrough. The door is movable between a first respective position covering effectively an entire portion of the access opening and a second respective position enabling access to the interior space through the access opening. The see-through window is attached to the door and at least partially covering a window opening in the door.

10 Claims, 2 Drawing Sheets

POSTAL MAILBOX

FIELD OF THE DISCLOSURE

The disclosures made herein relate generally to postal mailboxes and, more particularly, to postal mailboxes configured for enhancing visual inspection and containment of mail.

BACKGROUND

Postal mailboxes (i.e., mailboxes) of various types and configurations are well known. The underlying intent of such mailboxes is enabling mail to be conveniently and securely delivered and contained within the mailbox. To this end, conventional mailboxes include any number of functionalities that are intended to enhance the manner in which such delivery and containment of mail is accomplished.

Dual door mailboxes, which are well known, are one example of mailboxes that include functionality that is intended to enhance the manner in which delivery and containment of mail is accomplished. Such mailboxes have a first door at a first end and a second door at a second end. In regions utilizing mailboxes located adjacent to an edge of a roadway, a mail recipient having the dual door mailbox does not have to leave enter the roadway or shoulder area of the roadway to either place outgoing mail into or retrieve delivered mail from the mailbox. To make best use of such a dual door mailbox, the mailbox is mounted such that the first door is adjacent the roadway, thereby enabling a mail carrier to conveniently deposit mail into an interior space of the mailbox either while in a mail delivery vehicle. In such a mounted orientation, the second door faces away from the roadway. Accordingly, the mail recipient simply opens the second door to gain access to an interior space of the mailbox, allowing them to remain at a relatively safe distance from the roadway.

While such conventional dual-door mailboxes clearly offer advantages from a safety standpoint, they are not without shortcomings. One shortcoming is that, in the event that both doors of a dual-door mailbox are fully or partially open at the same time, wind may blow mail out of the mailbox because the floor is essentially level with the bottom edge of each door. Another shortcoming is the expense and complexity associated with implementing a means for ensuring that only one door is open at a time and/or ensuring that the doors are normally biased to a closed position. Still another shortcoming is that, because the floor of a conventional dual door mailbox is essentially level with the bottom of the doors, the volume of the mailbox is limited to a space above the bottom edge of the doors.

Mailboxes with one or more see-through windows in the mailbox body or a door of the mailbox or with one or more see-through walls are well known in the art and are another example of mailboxes that include functionality that is intended to enhance the manner in which delivery and containment of mail is accomplished. The intent of the one or more see-through windows or walls is to allow contents of the mailbox to be viewed prior to opening or otherwise disturbing the mailbox. As mentioned above with respect to dual door mailboxes, a shortcoming of single-door or dual-door mailboxes is that, because the floor of a conventional single-door or dual-door mailbox is essentially level with the bottom of the door or doors, the volume of the mailbox is limited to a space above the bottom edge of the door or doors. A related shortcoming is that overall visibility of relatively objects being viewed through the one or more see-through windows or walls is adversely impacted because of the relative vertical position of the one or more see-through windows with respect to a package resting on the floor of the mailbox. Inherently, for relatively large and/or tall packages, a relatively limited view of upper portion of the packages through the one or more see-through windows is often exhibited.

Therefore, a postal mailbox that that overcomes shortcomings associated with conventional postal mailboxes would be useful and advantageous.

SUMMARY OF THE DISCLOSURE

Embodiments of the present invention provide functionality that enhances the manner in which delivery and containment of mail (e.g., letters, packages, etc) within a mailbox. More specifically, embodiments of the present invention enable mail to be securely contained within a mailbox, even in the base of one or both doors being open, and enable a substantial portion of such mail to be visually inspected without opening the mailbox. In doing so, embodiments of the present invention advantageously overcome one or more shortcomings associated with conventional postal mailboxes.

In one embodiment of the present invention, a mailbox comprises a mailbox body and a door. The mailbox body has an interior space therein and an access opening through which the interior space is accessible. The interior space includes a cavity extending below a bottom edge of the access opening. The door is movably attached to the mailbox body adjacent the opening. The door is movable between a first respective position covering effectively an entire portion of the access opening and a second respective position enabling access to the interior space of the mailbox body through the access opening.

In another embodiment of the present invention, a mailbox comprises a mailbox body, a first door and a second door. The mailbox body has two opposed access openings therein and an interior space extending between the opposed access openings. The interior space includes a cavity extending below a bottom edge of at least one of the access openings. The first door is movably attached to the mailbox body adjacent a first one of the opposed access openings. The first door is movable between a first respective position covering effectively an entire portion of the first one of the opposed access openings and a second respective position enabling access to the interior space through the first one of the opposed access openings. The second door is movably attached to the mailbox body adjacent a second one of the opposed access openings. The second door is movable between a first respective position covering effectively an entire portion of the second one of the opposed access openings and a second respective position enabling access to the interior space through the second one of the opposed access openings.

In another embodiment of the present invention, a mailbox comprises a mailbox body, a door and a see-through window. The mailbox body has an interior space therein and an access opening through which the interior space is accessible. The interior space includes a cavity extending below a bottom edge of the access opening. The door is movably attached to the mailbox body adjacent the access opening and has a window opening extending therethrough. The door is movable between a first respective position covering effectively an entire portion of the access opening and a second respective position enabling access to the interior space through the access opening. The see-through window is attached to the door and at least partially covers a window opening in the door.

Turning now to specific aspects of the present invention, in at least one embodiment, a width of the cavity is essentially the same as a maximum width of the interior space.

In at least one embodiment of the present invention, a window opening is provided in a wall of the mailbox body that defines an interior face of the cavity and a see-through window is attached to the wall and at least partially covering the window opening.

In at least one embodiment of the present invention, the wall that the see-through window is attached is a side wall of the cavity.

In at least one embodiment of the present invention, the wall that the see-through window is attached is an end wall of the cavity and the end wall is directly below the access opening of the mailbox body.

In at least one embodiment of the present invention, a first window opening is provided in a first end wall of the mailbox body defining an interior face of the cavity, the first end wall is directly below the access opening, a first see-through window is attached to the first end wall over the first window opening, a second window opening is provided in a second end wall of the mailbox body defining an interior face of the cavity, the second end wall is opposite the first end wall and a second see-through window is attached to the second end wall and at least partially covering the second window opening.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
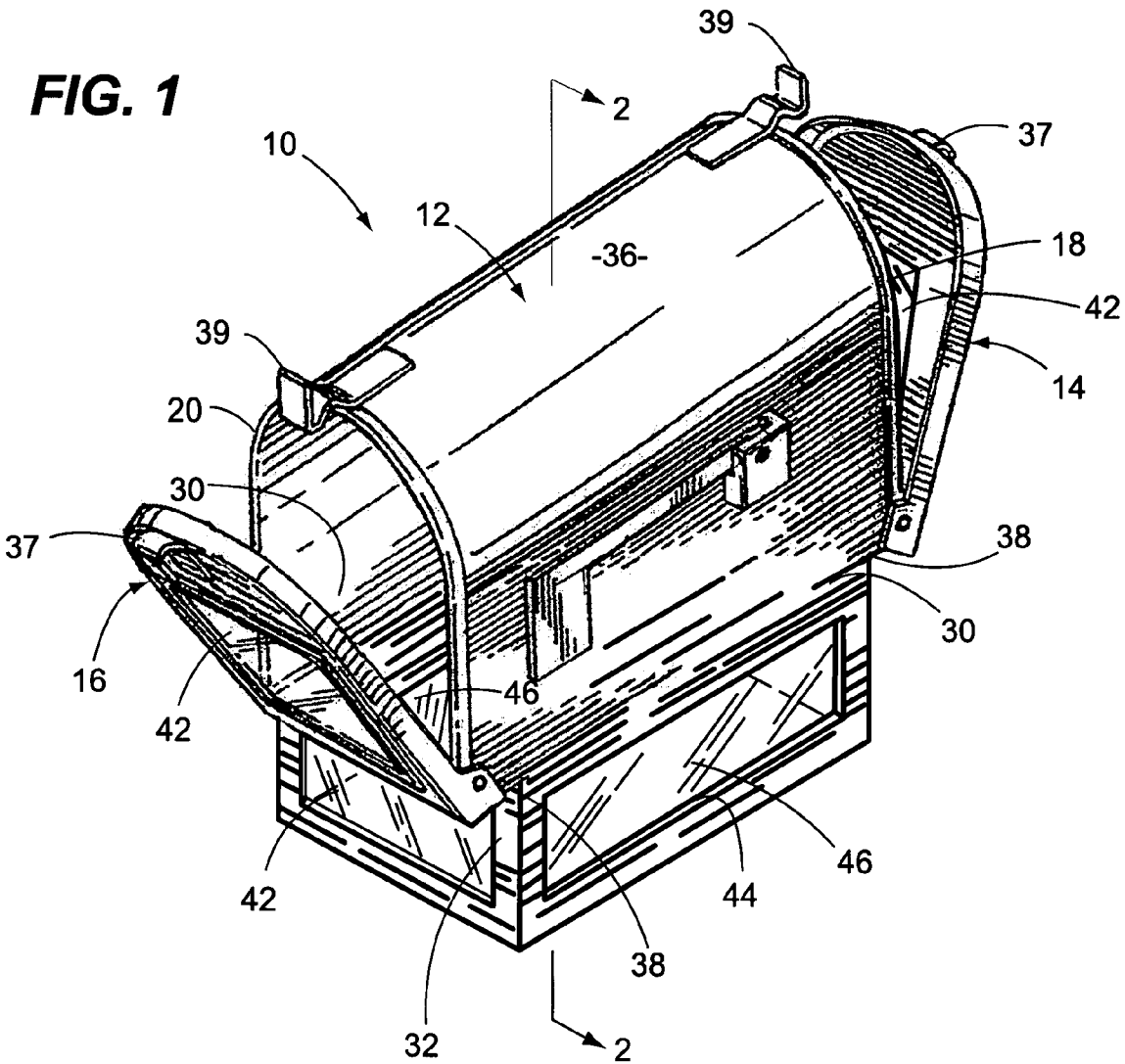
FIG. 1 depicts an embodiment of a mailbox in accordance with the present invention.
Figure 2:
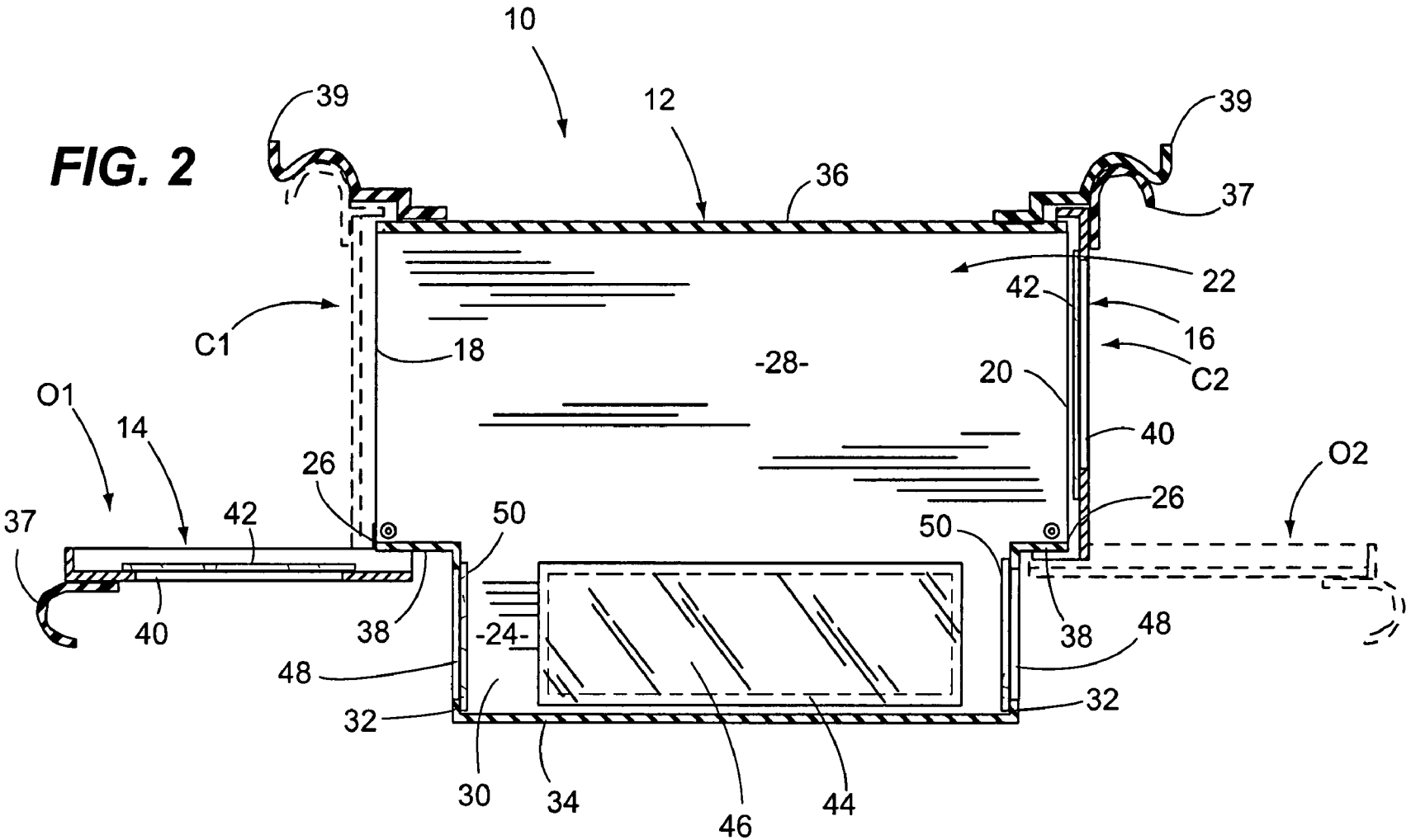
FIG. 2 is a cross-sectional view taken along the line 2-2 in FIG. 1.

FIGS. 1 and 2 depict an embodiment of a mailbox in accordance with the present invention, which is referred to herein as the mailbox 10. The mailbox 10 includes a mailbox body 12, a first door 14 and a second door 16. The mailbox body 12 has a first access opening 18 and a second access opening 20. As depicted, the two access openings (18, 20) are opposed with respect to each other. An interior space 22 (best shown in FIG. 2) extends between the first access opening 18 and the second access opening 20.

The interior space 22 includes a cavity 24 extending below a bottom edge 26 of the access openings (18, 20) and a main portion 28 above the cavity 24. Advantageously, the cavity 24 provides for a recessed portion of the mailbox body 12 in which mail is captured. Because the mail is captured in the cavity 24, much better protection against the mail being accidentally blown out of the mailbox 10, such as in the case where both doors (14, 16) are accidentally left open.

The cavity 24 is defined by opposed side walls 30, opposed end walls 32 and a bottom wall 34. The opposed side walls 30 and the opposed end walls 32 define respective side faces of the cavity 24. Preferably, as depicted, the opposed side walls 30, the opposed end walls 32 and the bottom wall 34 are generally flat and interconnected in a manner such that the cavity has a rectangular-shaped volume. The opposed side walls 30 each extend upward from adjacent the cavity 24 and are curved toward each other to form an arch shaped top surface 36. Optionally, the opposed side walls 32 may be terminate into a flat or curved top wall. The opposed end walls 32 each terminate into a respective ledge 38 such that each end face 32 of the cavity 24 is recessed with respect to the access opening (18, 20). The cavity 24 preferably, but not necessarily, has a width essentially the same as a maximum width of the interior space 22.

The first door 14 is pivotally attached to the mailbox body 12 adjacent the first access opening 18. The first door 14 is pivotable between a first respective position covering effectively an entire portion of the first access opening 18 (i.e., a closed position C1) and a second respective position enabling access to the interior space 22 through the first access opening 18 (i.e., a respective open position O1). The second door 16 is pivotally attached to the mailbox body 12 adjacent a second access opening 20. The second door 16 is pivotable between a first respective position covering effectively an entire portion of the second access opening 20 (i.e., a closed position C2) and a second respective position enabling access to the interior space 22 through the second access opening 20 (i.e., a respective open position O2). Each door (14, 16) includes a handle 37 that engages a mating retention member 39 when each door (14, 16) is in a respective closed position.

Each door (14, 16) has a window opening 40 therein and a see-through window 42 covering the window opening 40. Each opposed side wall 30 of the cavity 24 has a window opening 44 therein and a see-through window 46 covering the window opening 44. Each opposed end wall 32 of the cavity 24 has a window opening 48 therein and a see-through window 50 covering the window opening 48. Advantageously, the see-through windows (42, 46, 50) enable a substantial portion, if not an entire portion, of the contents of the mailbox 10 to be viewed without opening the doors (14, 16) of the mailbox 10. It is disclosed herein that a single see-through window may be provided in only one of the doors and/or only one of the walls defining the cavity 24.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A mailbox, comprising a mailbox body defining an interior space therein and a pair of opposed access openings through which said interior space is accessible;

a cavity having a pair of opposed side walls, a pair of end walls, and a bottom wall, said pair of end walls extending from said bottom wall and terminating at a shoulder relative to said opposed access openings, wherein said cavity is recessed with respect to said opposed access openings and in communication with said interior space, and accessible through said opposed access openings; and a first and second door pivotally attached to said mailbox body adjacent said opposed access openings, respectively, said first and second doors each being movable between a closed position covering an entire portion of a respective one of said access openings and an open position providing access to said interior space and said cavity through said respective one of said two access openings, wherein said cavity, said interior space, and said opposed access openings are jointly configured so as to allow mail contained within said cavity to be removed through either one of said opposed access openings.

2. The mailbox as in claim 1, wherein:

said first and second doors each include a respective window opening therein and a see-through window covering said respective window opening;

each said side wall includes a respective side wall window opening and a respective side wall see-through window covering said respective side wall window opening; and each said end wall includes a respective end wall window opening and a respective end wall see-through window covering said respective end wall window opening.

3. The mailbox as in claim 1, wherein said side walls extend upward from adjacent said cavity and are curved toward each other to form an arch shaped top surface.

4. The mailbox as in claim 3 wherein said cavity includes a width essentially the same as a maximum width of said interior space.

5. The mailbox as in claim 1 wherein each said door includes a handle having a configuration complementary to a respective retention member when a respective door is in said closed configuration.

6. A mailbox, comprising:

a mailbox body defining an interior space therein and a pair of opposed access openings through which said interior space is accessible;

a cavity having a pair of opposed side walls, a pair of end walls, and a bottom wall, said pair of end walls extending from said bottom wall and terminating at a shoulder relative to said opposed access openings, wherein said cavity is recessed with respect to said opposed access openings and in communication with said interior space, and accessible through said opposed access openings;

a first and second door pivotally attached to said mailbox body adjacent said opposed access openings, respectively, said first and second doors each being movable between a closed position covering an entire portion of a respective one of said access openings and an open position providing access to said interior space and said cavity through said respective one of said two access openings, wherein said cavity, said interior space, and said opposed access openings are jointly configured so as to allow mail contained within said cavity to be removed through either one of said opposed access openings; and each said side wall includes a respective side wall window opening and a respective side wall see-through window covering said respective side wall window opening.

7. The mailbox as in claim 6, wherein:

said first and second doors each include a respective window opening therein and a see-through window covering said respective window opening; and each said end wall includes a respective end wall window opening and a respective end wall see-through window covering said respective end wall window opening.

8. The mailbox as in claim 6, wherein said side walls extend upward from adjacent said cavity and are curved toward each other to form an arch shaped top surface.

9. The mailbox as in claim 6 wherein said cavity includes a width essentially the same as a maximum width of said interior space.

10. The mailbox as in claim 6 wherein each said door includes a handle having a configuration complementary to a respective retention member when a respective door is in said closed configuration.

* * * * *